US008099921B2

(12) United States Patent
Muehlebach

(10) Patent No.: US 8,099,921 B2
(45) Date of Patent: Jan. 24, 2012

(54) PROFILE STRIP SYSTEM, ESPECIALLY FOR CLOSING OFF EDGES AND/OR CONCEALING JOINTS, FOR A SURFACE COVERING

(75) Inventor: Moritz Muehlebach, Dietlikon (CH)

(73) Assignee: Proverum AG, Baar (CH)

( * ) Notice: Subject to any disclaimer, the term of this patent is extended or adjusted under 35 U.S.C. 154(b) by 210 days.

(21) Appl. No.: 12/525,468

(22) PCT Filed: Jan. 16, 2008

(86) PCT No.: PCT/EP2008/000279

§ 371 (c)(1),
(2), (4) Date: Jul. 31, 2009

(87) PCT Pub. No.: WO2008/092561

PCT Pub. Date: Aug. 7, 2008

(65) Prior Publication Data

US 2010/0031596 A1 Feb. 11, 2010

(30) Foreign Application Priority Data

Feb. 2, 2007 (DE) ..... 10 2007 006 075
Feb. 23, 2007 (DE) ..... 10 2007 009 364

(51) Int. Cl.
*E04C 3/00* (2006.01)
*E04D 1/36* (2006.01)

(52) U.S. Cl. ..... 52/468; 52/396.04; 52/506.05

(58) Field of Classification Search ..... 52/396.04, 52/396.06, 396.07, 461, 463–466, 468, 506.05
See application file for complete search history.

(56) References Cited

U.S. PATENT DOCUMENTS

| | | | | |
|---|---|---|---|---|
| 3,667,177 | A | 6/1972 | Biela | |
| 3,832,820 | A * | 9/1974 | Eggert | 52/506.08 |
| 4,067,155 | A * | 1/1978 | Ruff et al. | 52/105 |
| 4,893,449 | A * | 1/1990 | Kemper | 52/464 |
| 5,423,157 | A * | 6/1995 | Watanabe | 52/745.08 |
| 5,461,834 | A * | 10/1995 | Carlberg | 52/466 |
| 6,588,165 | B1 | 7/2003 | Wright | |
| 6,745,534 | B2 * | 6/2004 | Kornfalt | 52/468 |
| 7,207,143 | B2 * | 4/2007 | Stanchfield | 52/459 |

(Continued)

FOREIGN PATENT DOCUMENTS

EP 1 183 972 A1 3/2002

(Continued)

*Primary Examiner* — Basil Katcheves
*Assistant Examiner* — Beth Stephan
(74) *Attorney, Agent, or Firm* — Roberts Mlotkowski Safran & Cole, P.C.; David S. Safran

(57) ABSTRACT

A profiled strip system, in particular for closing off edges and/or for concealing joints, for a surface covering, having a lower base profile and an upper cover profile, wherein a latching connection is provided between the base profile and the cover profile to connect them, wherein the latching connection has a latching receptacle, which has two leg profiles with mutually opposite latching regions, and a latching profile which can be latched into the latching receptacle and which is provided with multiple latching points, and wherein each latching region has at least two latching points. The latching regions are provided only in certain regions on the leg profiles and portions of the leg profiles that are free of latching regions are situated at far from one another such that the latching region-free sections of the leg profiles further from one another than the latching regions.

24 Claims, 7 Drawing Sheets

U.S. PATENT DOCUMENTS

| | | | | |
|---|---|---|---|---|
| 7,409,802 | B2 * | 8/2008 | Fiedler | 52/466 |
| 7,784,238 | B2 * | 8/2010 | Bannister | 52/465 |
| 2002/0000072 | A1 * | 1/2002 | McGrath et al. | 52/466 |
| 2002/0095895 | A1 * | 7/2002 | Daly et al. | 52/464 |
| 2006/0150565 | A1 | 7/2006 | Schacht et al. | |
| 2007/0056239 | A1 | 3/2007 | Schacht et al. | |

FOREIGN PATENT DOCUMENTS

| | | | |
|---|---|---|---|
| WO | 00/16611 | A2 | 3/2000 |
| WO | 2006/073321 | A1 | 7/2006 |
| WO | 2007/008094 | A1 | 1/2007 |

* cited by examiner

PROFILE STRIP SYSTEM, ESPECIALLY FOR CLOSING OFF EDGES AND/OR CONCEALING JOINTS, FOR A SURFACE COVERING

BACKGROUND OF THE INVENTION

1. Field of Invention

The invention relates to a profile strip system, especially for closing off an edge and/or for concealing a joint, for a covering, with a lower base profile and an upper cover profile, between the base profile and the cover profile there being a latching connection for joining, the latching connection having a latching receptacle which has two leg profiles with opposite latching regions which are active for latching, and a latching profile which can be latched into the latching receptacle with a plurality of latching sites, each latching region having at least two latching sites, there being latching regions only in regions on the leg profiles and the latching region-free sections of the leg profiles having a greater distance from one another than the latching regions.

2. Description of Related Art

Profile strip systems of the aforementioned type are already known from practice. These profile strip systems are used especially in conjunction with floor coverings, but also for wall and ceiling coverings. Installation of these coverings is generally very simple. Achieving a clean terminating edge on the edges of these coverings is often problematical here. To close off the edges, but also to conceal joints therefore profile strip systems of the initially named type are used. The known profile strip systems with a latching connection between the base profile and the cover profile are conventionally characterized in that the latching connection enables vertical adjustability, therefore the profile strip system can be matched to different covering thicknesses.

In addition to vertical adjustability, there is the further requirement for profile strip systems that it is to be possible to tilt the cover profile relative to the base profile in order, in this way, to enable equalization of the level between coverings of varied height, between which the profile strip system is located.

European Patent Application EP 1 183 972 A1 discloses a profile strip system which enables both vertical adjustability and also a pivoting capacity, and thus, tilting of the cover profile relative to the base profile. The base profile, for this purpose, has a U-shaped latching receptacle with two latching legs. These latching legs have latching regions over their entire length on opposite sides which are used for latching in different vertical positions and are accordingly necessary for this purpose. On the cover profile, there is a latching head with arched contact surfaces on the sides. For latching purposes, the latching head is placed on the latching receptacle and then hammered into it. The problem in the known profile is that, to achieve a pivoting capacity that is as step-less as possible, a very fitted and fine interlocking is necessary; often, this cannot be easily ensured in mass production. Moreover, very fine interlocking results in that the latching connection, in any case, can become loose when more strongly loaded.

SUMMARY OF THE INVENTION

The object of this invention is to provide a profile strip system of the initially described type with which matching to different vertical positions is easily possible, and otherwise, a reliable connection between the base profile and the cover profile is to be ensured.

The aforementioned object is essentially achieved in accordance with the invention in that there are latching regions only in areas on the leg profiles and that the leg profiles outside of the latching regions have a spacing from one another such that the latching profile inserted into the latching receptacle can be pivoted relative to the latching receptacle. In other words, the latching region-free sections of the leg profiles have a greater distance from one another than the latching regions so that the aforementioned pivoting capacity is possible.

The aforementioned configuration in accordance with the invention diverges greatly from the initially mentioned prior art and offers a series of, in part, important advantages. First of all, in this invention, it is such that the latching regions which are active for latching—differently than in the prior art—do not extend over the entire length of the leg profiles, but are provided only in regions, preferably only on the outer free ends of the leg profiles. Therefore, only a relatively short latching region on each of the legs is preferred. The other sections on which latching does not take place or is also only possible in any latching position, and which are therefore called "latching region-free," are offset to the outside relative to the latching regions, and thus, have a greater distance from one another than the latching regions. This then yields free space which can be used for pivoting in the latching receptacle. In this connection, the circumstance that each latching region has at least two latching sites becomes especially important. The two latching sites, on the one hand, ensure that there is reliable and at least essentially play-free latching between the base profile and the cover profile.

Ultimately, unwanted motion back and forth in the vertical direction of the cover profile relative to the base profile is precluded by at least two latching sites on each latching receptacle of the base profile and based on the plurality of latching sites on the latching profile of the cover profile. Furthermore, the at least two latching sites on each latching region lead to the fact that, when the cover profile with the latching profile is pivoted relative to the base profile, even with fine interlocking of the latching sites, there is still an adequate latching connection between the latching receptacle and latching profile. If there were only one latching site per latching region on the latching receptacle, this could not necessarily be ensured. Based on this execution, the latching regions are used, on the one hand, for latching and on the other as the pivot point for pivoting of the latching profile. In this execution, very fine interlocking is not necessary. The latching profile is inserted for latching into the latching receptacle, i.e., between the latching regions of the leg profiles which are made preferably as spring legs, and are latched there. Since the latching regions are only very short, pivoting of the latching profile is easily possible for matching the cover profile to different vertical positions of the floor covering, the latching connection between the latching receptacle with at least two latching sites per latching region and the lockable latching profile with a plurality of latching sites is preserved regardless of the pivoting position.

In order to enable sufficient pivoting of the latching profile relative to the latching receptacle, the maximum distance of the latching region-free sections of the leg profiles which can be used for pivoting is at least 1.2 times, especially at least 2 times greater than the inside width between the latching regions. In this way, it can be ensured that the latching profile, which has been latched or inserted into the latching receptacle, can be pivoted relative to the vertical in a region greater than 1°, preferably, in an angular region of up to 10°, within the free space in the latching receptacle.

Preferably, in the invention, it is such that the regions of the leg profiles on which there is a respective latching region are bent relative to the latching region-free section. In this way, the space necessary for pivoting of the latching profile can be provided within the latching receptacle. Fundamentally, however, it is also possible for the leg profiles to be arranged altogether running obliquely relative to one another. This yields a triangle-like shape of the latching receptacle that is open to the top. In all embodiments, it is such that the leg profiles act ultimately as spring legs when the latching profile is latched in, and if necessary, is pivoted relative to the latching receptacle.

As already mentioned, the latching regions in the invention have only a relatively short lengthwise extension. In one preferred embodiment of the invention, it is such that the length of the leg profiles is more than twice the lengthwise extension of the latching region. Depending on the requirement, the length of the leg profiles can even be more than 10 times the lengthwise extension of the latching regions, also any optional intermediate value being possible.

In order to be able to ensure, on the one hand, reliable latching, and on the other, however, a pivoting capacity of the latching profile around the latching regions, each of the latching regions should have two, three, four, five or six latching sites. The latching sites can be fundamentally simple projections. But, it is preferred that a sawtooth-like arrangement be provided, especially with sharp-edged latching teeth, preferably in the form of barbs, in order to achieve, in this way, reliable and strong and otherwise preferably also an undetachable latching connection.

Preferably, in this invention, it is such that the facing latching regions of the leg profiles run over their entire length parallel to one another and are otherwise aligned vertically. Corresponding to the latching regions of the leg profiles, the latching profile, on opposite sides, likewise, has further latching regions which run parallel to one another over their entire length. The other latching regions, as already stated, likewise, have a plurality of latching sites which are arranged preferably sawtooth-like according to the latching sites on the latching receptacle with sharp latching teeth, especially in the form of barbs. For the sake of simplicity, in this connection, it is recommended that the latching profile be made as a simple leg profile even if it is fundamentally also possible to make the latching profile, for example, U-shaped.

Fundamentally, it is possible to arrange the leg profiles both on the base profile and also on the cover profile even if it has been shown that the top-side arrangement on the base profile is more favorable. Accordingly, the latching profile is provided on the cover profile, or for an especially preferred alternative, on an intermediate profile which can be connected to the cover profile. Thus, the profile strip system can have either a two-piece or three-piece execution. The use of an intermediate profile does offer some advantages. By using different intermediate profiles with latching profiles of different length, the most varied covering heights can be covered with the same cover profile.

Moreover, it is easily possible by way of a separate intermediate profile to implement an additional swivelling capacity between the cover profile and the intermediate profile. This ultimately leads to twice the pivoting capacity, specifically, on the one hand, a pivoting capacity of the latching profile relative to the base profile, and on the other hand, a pivoting capacity of the cover profile relative to the intermediate profile. Due to the doubled pivoting capacity, ultimately, very exact matching of the cover profile to the covering or different covering heights can be effected; this cannot be easily ensured for only the single pivoting capacity which is known from the prior art.

In conjunction with the pivoting capacity of the cover profile relative to the intermediate profile, it has been shown that it is adequate for conventional applications if the cover profile relative to the intermediate profile can be pivoted in any angle of up to 20° relative to the vertical and especially up to 15°. For this pivoting capacity, the conventional height differences between thicker and thinner coverings can be easily equalized.

Fundamentally, there are various possibilities for implementing the pivoting capacity between the intermediate piece and the cover profile. It has been proven to be especially advantageous if the intermediate piece has an articulated head, while on the bottom on the cover profile it has a groove for insertion of the articulated head. In one preferred embodiment of the invention, the articulated head has a leg in the shape of a segment of a circular arc, the groove being made accordingly in the shape of a segment of a circular arc. Here the outside of the articulated head adjoins the facing groove side over its entire surface. To be able to ensure the pivoting capacity in this embodiment, it goes without saying that the articulated head is shorter than the groove. Therefore, the aforementioned embodiment is recommended over a round articulated ball head since it takes up relatively little space so that the profile strip system in accordance with the invention is very flat. Moreover, the very large articulated head offers good impact transfer in installation. Possible impact transfer is not easily ensured, for example, for a round articulated head.

In one alternative embodiment, it is provided that the groove is made with the shape of a dovetail with an arch to the outside. The articulated head is matched to the dovetail shape, the outside of the articulated head likewise being arched to the outside. This yields only spot or partial surface contact between the groove and the articulated head, since only the parts or regions which are arched to the outside touch.

Moreover, it is especially advantageous if the latching leg is located off-center on the cover profile. The off-center arrangement means that, viewed in cross section, one part or arm of the cover profile is shorter than the other part of the cover profile. The advantage of the off-center arrangement consists in that, in this way, ultimately a greater height difference can be bridged between the bordering coverings. The aforementioned advantage arises otherwise regardless of whether there is a latching leg on the separate intermediate profile or directly on the cover profile.

Even if it is fundamental to produce the cover profile, the base profile and also the intermediate profile from any material, it is recommended that all three profiles be produced from aluminum, especially as extruded profiles. Different from the prior art, where conventionally a plastic is used at least for the base profile, in the consistent use of aluminum, it is ensured that there is no material fatigue; this could otherwise adversely affect the latching connection.

In order to ensure secure attachment of the base profile to the subfloor, the base profile has a horizontally running bottom leg profile which is designed for connection to the subfloor. For this purpose the bottom leg profile has a plurality of screw openings, for example, also in the form of lengthwise running and crosswise running slots and/or round holes.

Even if the configuration in accordance with the invention offers reliable attachment of the cover profile to the base profile and selective angle setting of the cover profile with simultaneous vertical adjustability, for various applications for closing off an edge, it can be recommended that a separate terminating profile be provided which terminates the region on the side facing away from the covering. This is recommended if the terminating profile can be joined to the cover profile. To achieve a single connection between the cover profile and the terminating profile, in one preferred embodiment, it is provided that a groove is made on the bottom on the cover profile for inserting a projection which is provided on the top on the terminating profile. The terminating profile can be either inserted into the cover profile or can be latched into it.

In this connection, it is especially advantageous to arrange the groove on the cover profile diagonally relative to the top of the cover profile or relative to the horizontal. The diagonal arrangement of the groove and the corresponding diagonal arrangement of the inserted terminating profile facilitate the swivelling capacity of the cover profile relative to the base profile.

In order to have different installation possibilities, it is recommended that the terminating profile be made U-shaped or hollow, the two outer legs having a different slope or shape. Depending on the installation position, on the outside there is a larger or smaller slope as a result of the respective outer leg.

It was already pointed out previously that the use of an intermediate profile is also advantageous in that different intermediate profiles easily allow use of the profile strip system for surface coverings of varied thickness. In this connection, it is recommended that the profile strip system in accordance with the invention be offered as a kit with at least one bottom profile, at least one cover profile and at least two intermediate profiles, the length of the latching legs of the intermediate profiles being different. Therefore, ultimately, in each kit there is a given number of base and cover profiles and a conversely larger number or at least twice the number of intermediate profiles. Incidentally such a kit can also have a corresponding number of terminating profiles which are made differently if necessary so that the user if necessary can choose between different profiles which are to form the side termination.

Finally it should be pointed out that the intervals and range limits given above encompass all values which lie within the intervals and range limits, even if they are not mentioned individually.

Other features, advantages and possible applications of this invention will become apparent from the following detailed description of preferred embodiments with reference to the accompanying drawings.

DETAILED DESCRIPTION OF THE INVENTION

In the individual figures, respective profile strip systems 1 are shown which can be used both for closing off an edge and also for concealing a joint. It is pointed out that the profile strip system in accordance with the invention and the aforementioned features and those to be described individually below, fundamentally, can also be used for a cable duct formed from a profile strip system, even if it is not shown.

Figure 9:
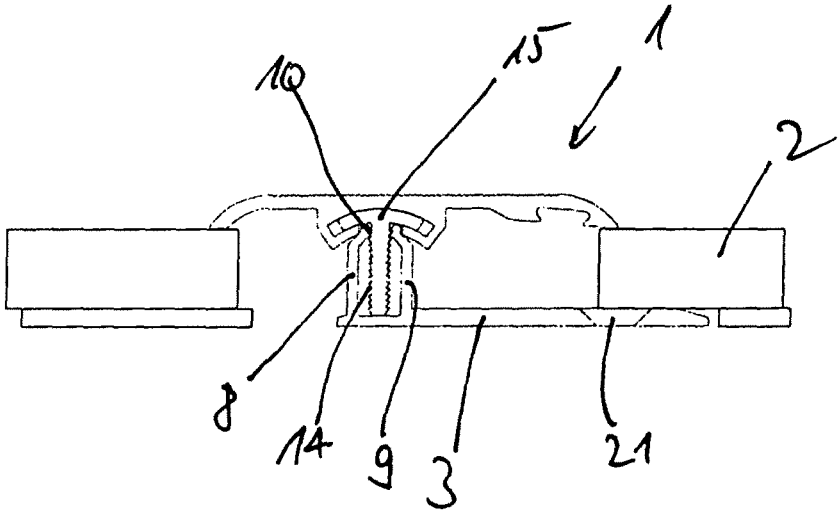
FIGS. 9 & 10 show views of another profile strip system.
Figure 10:
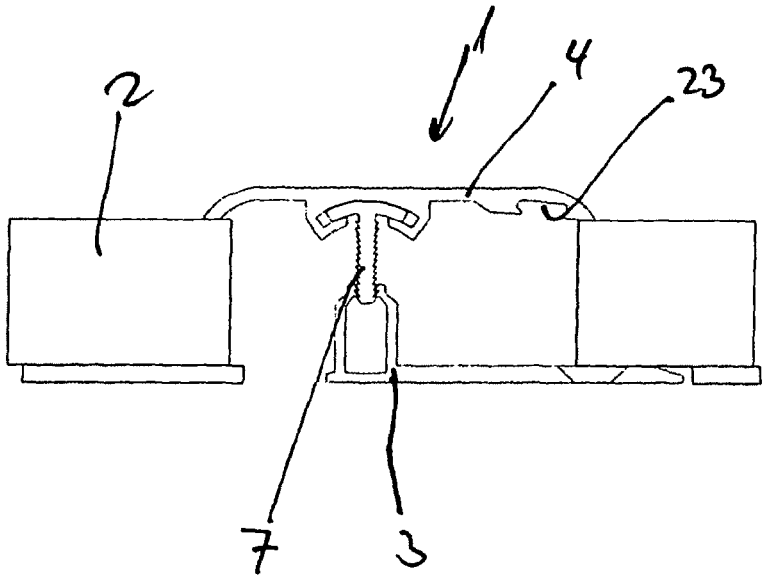

In the embodiments shown in FIGS. 1 to 4, FIGS. 9 & 10, FIGS. 11 to 13 and FIGS. 18 to 20, the profile strip system 1 is used for joint concealment, while in the embodiments of FIGS. 5 to 8 and FIGS. 14 to 17 it is used for closing off the edge for a surface covering 2. The profile strip system 1, itself, has a lower elongated base profile 3 and an upper elongated cover profile 4. Between the base profile 3 and the cover profile 4, there is a latching connection 5 to join the two profiles 3, 4 to one another. As follows from a comparison, for example, of FIGS. 1 & 2, the latching connection 5, however, not only has a connection function, but ensures otherwise vertical adjustability of the cover profile 4 relative to the base profile 3. Thus, for example, in the embodiment shown in FIGS. 1 & 2, vertical travel of 5 mm can be achieved, while in the embodiment as shown in FIGS. 9 & 10, there is vertical travel of 8 mm.

The latching connection 5, in all cases, has a latching receptacle 6 into which a latching profile 7, which has a plurality of latching sites, can be latched. The latching receptacle 6 is formed by two leg profiles 8, 9 which have latching regions 10 on opposite sides. Each of the latching regions 10 has at least two latching sites which are active during latching. Therefore, a "latching region" is a region at which latching is possible on the leg profiles 8, 9. Conversely, those regions of the leg profiles 8, 9 on which latching is not possible are called latching region-free sections 11.

Figure 13:
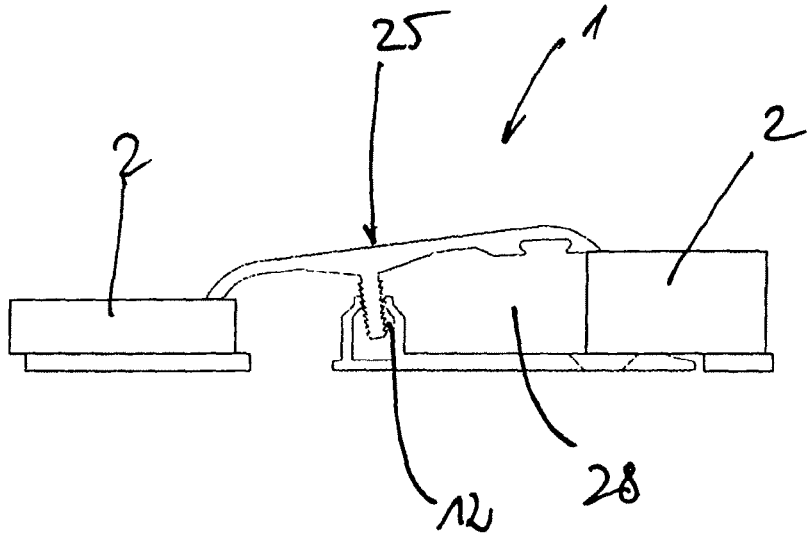
Figure 14:
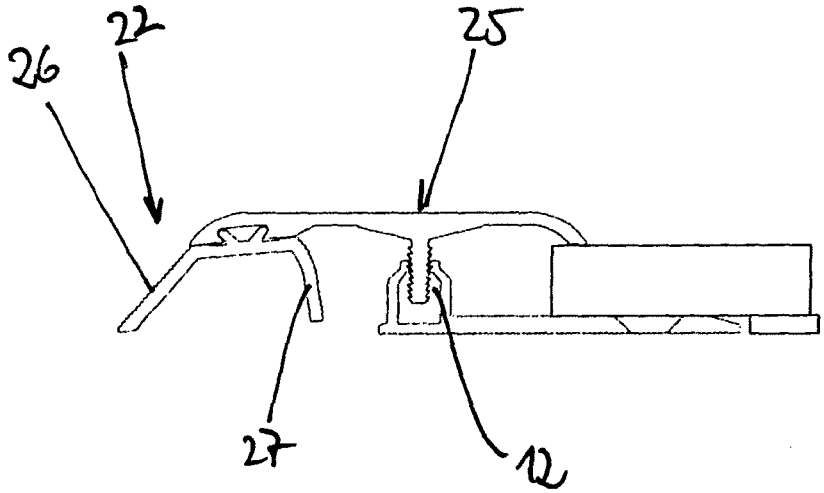
FIGS. 14-17 show views of a profile strip system as used for closing off an edge in conjunction with a terminating profile and FIGS. 18-20 show views of another embodiment of the profile strip system in accordance with the invention as used for joint concealment.
Figure 15:
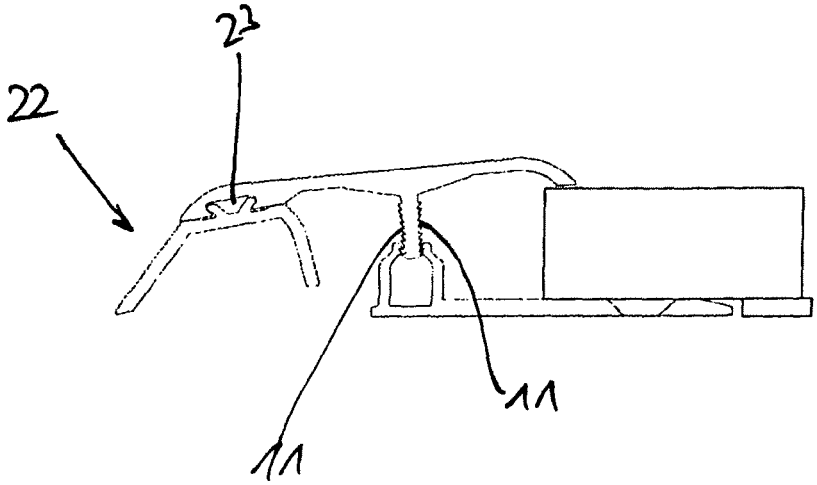
Figure 16:
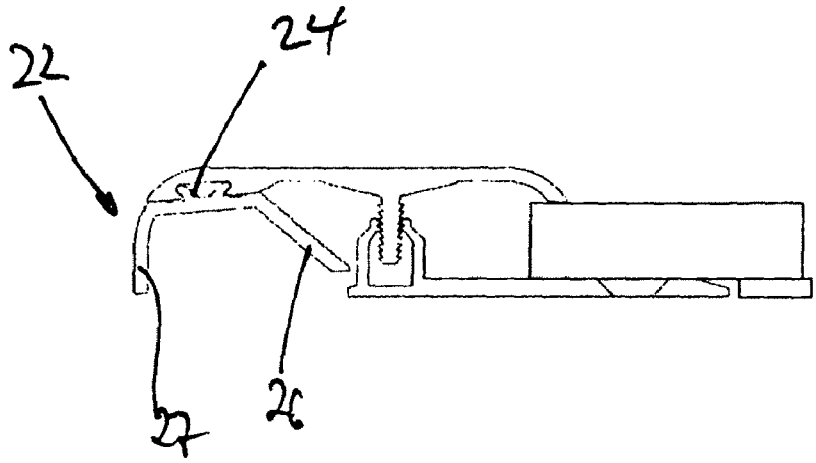
Figure 17:
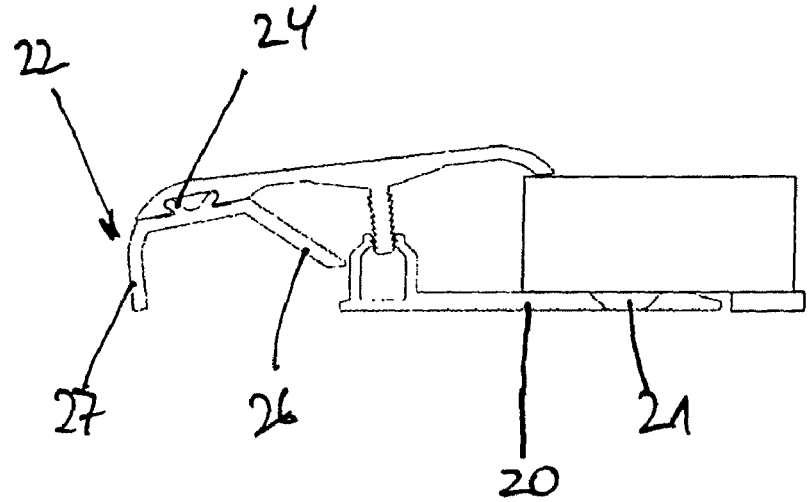

It is provided that there are latching regions 10 only in a limited area of the leg profiles 8, 9. Moreover the latching region-free sections 11 of the leg profiles 8, 9 have a greater distance from one another than the latching regions 10 so that the latching profile 7 inserted into the latching receptacle 6 can be pivoted relative to the latching receptacle 6 and the base profile 3. This state is shown, for example, in FIGS. 4, 13, 15 & 17. In all cases, it is such that the cover profile 4 here is shown pivoted to the left. Regardless of the pivoting direction, the pivoting point is within the latching regions 10, and in the illustrated embodiments, the right leg profile being moved or springing somewhat to the outside. In spite of this outward pressing of the right leg profile, the latching connection is still kept between the latching profile 7 and the two latching regions 10. Here, especially FIG. 13 illustrates that the lower end of the latching profile 7 in the free space or intermediate space 12 provided in the lower region of the latching receptacle 6 without its lower end striking either of the leg profiles 8, 9. Ultimately, the latching profile 7 is held only on the latching regions 10, otherwise there is no connection between the leg profiles 8, 9 and the latching profile 7. By spacing the latching region-free sections 11 of the leg profiles 8, 9 apart from one another, as a result the free space 12 is made available which enables pivoting of the latching profile 7 within the latching receptacle 6.

As otherwise follows from the individual figures, there are latching regions 10 on the outer free ends 13 of the leg profiles 8, 9. The maximum distance of the latching region-free sections 11 of the leg profiles 8, 9 which can be used for pivoting of the latching profile 7 within the latching receptacle 6, here, is at least twice that of the inside width between the latching regions 10. In this way, when the latching profile 7 is inserted into the latching receptacle 6, it can be pivoted relative to vertical in a small angular range of up to 100. To implement spacing or free space 12 within the latching receptacle 6, the upper region of the respective leg profile 8, 9 is bent. In the illustrated embodiment, there is a diagonal bend. This diagonal bend has the advantage that the latching profile 7 can be inserted relatively far into the latching receptacle 6. Instead of diagonal bending, it is also fundamentally possible to bend the upper region of the leg profiles 8, 9 at a right angle. It is also fundamentally possible to arrange the leg profiles 8, 9 altogether diagonally so that there is a triangle-like shape which is open to the top.

In any case, in the invention, it is such that the length of the leg profiles 8, 9 is more than twice the lengthwise extension of the latching region 10. In the illustrated embodiments the length of each of the leg profiles 8, 9 is larger by a factor of at least 5 than the lengthwise extension of the respective latching region 10. Furthermore, in all the illustrated embodiments, it is such that each of the latching regions 10, in any case, has less than ten latching sites. Preferably, there are only two latching sites on each leg profile 8, 9. The latching sites here are barb-shaped latching teeth which are ultimately pointed at least essentially downward. Accordingly, there are corresponding latching sites or latching teeth on the latching profile 7. Different from the latching regions 10 of the leg profiles 8, 9, however, on opposite outer sides of the latching profile 7, there are latching sites which extend at least essentially over the entire length of the two outer sides of the latching profile 7.

Otherwise, in all embodiments, it is such that the latching regions 10 of the leg profiles 8, 9 run parallel to one another and/or are aligned vertically, even if it is also possible to align the latching regions diagonally relative to one another so that there is a triangular shape which narrows toward the top. Fundamentally, it is also possible to make the latching regions crowned. However, in this embodiment, there must be more than two latching sites.

Furthermore, in all embodiments, it is such that the latching profile 7, on opposite sides, has other latching regions 14 which run parallel to one another, which are otherwise aligned vertically and which, as stated above, extend essentially over the entire length of latching profile 7.

The leg profiles 8, 9 are located, here, on the top side on the base profile 3, the leg profiles 8, 9 extending upward. Accordingly, in any case, the latching profile 7 in the embodiments of FIGS. 11 to 17 is located directly on the cover profile 4, while in the embodiments as shown in FIGS. 1 to 8, it is provided on an intermediate profile 15 which can be connected to the cover profile 4. Comparison of FIGS. 1 to 8, on the one hand, with FIGS. 9 & 10, on the other, shows that there are different intermediate profiles 15. Specifically, shorter and longer latching profiles 7 can be provided. Otherwise, in the embodiments of FIGS. 1 to 8 and 9 & 10, it is such that there are also correspondingly matched latching receptacles 6, i.e., shorter and longer ones. Here, it goes without saying that a shorter latching receptacle 6 according to FIGS. 1 to 8 with a longer intermediate piece according to FIGS. 9 & 10 can also be used and also a taller latching receptacle 6 can be used with a shorter intermediate piece 15.

Figure 6:
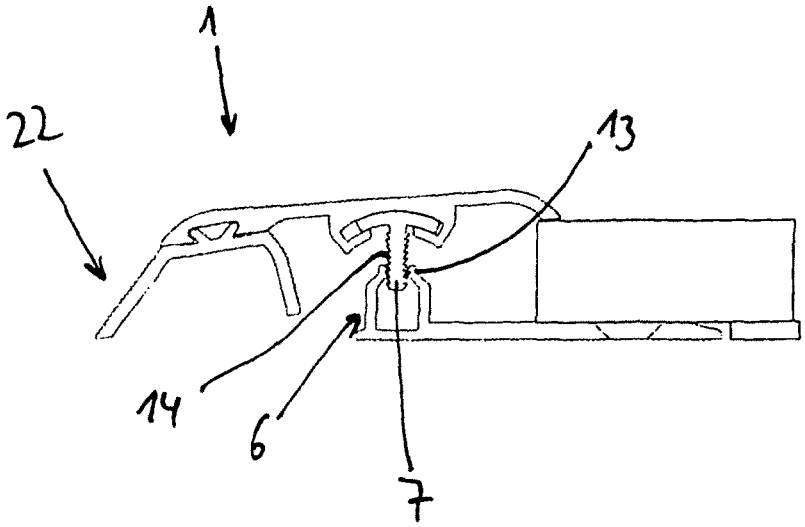
Figure 7:
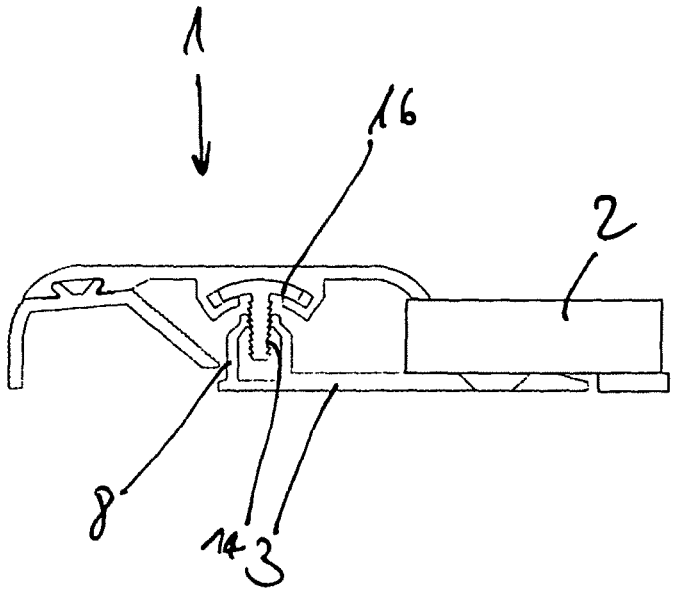
Figure 8:
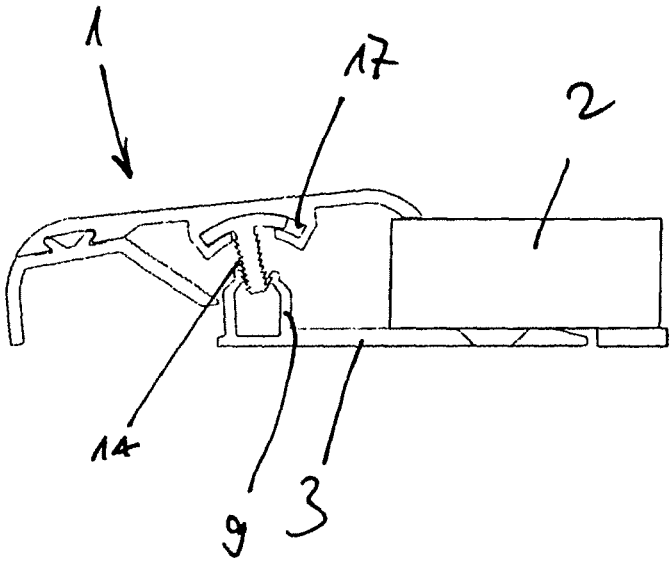

Otherwise, the cover profile 4 can be pivoted relative to the intermediate profile 15, as follows, for example, from FIGS. 3, 4 & 6. Here, defined pivoting in an angular range up to 20° relative to vertical is possible. To implement the pivoting capacity, in the embodiments shown in FIGS. 1 to 10, on the intermediate piece 15, there is a relatively flat articulated head 16 with the shape of a segment of a circular arc, while on the bottom on the cover profile 4 there is a groove 17 with the shape of a segment of a circular arc for insertion of the articulated head 16. The extension of the arc of the slotted groove 17 is greater than that of the articulated head 16 in order to enable the aforementioned pivoting capacity. It is not shown that the intermediate piece 15 with the articulated head 16 can be inserted into the groove 17. In this connection, the intermediate piece 15 extends over the entire length of the cover profile 4.

Figure 18:
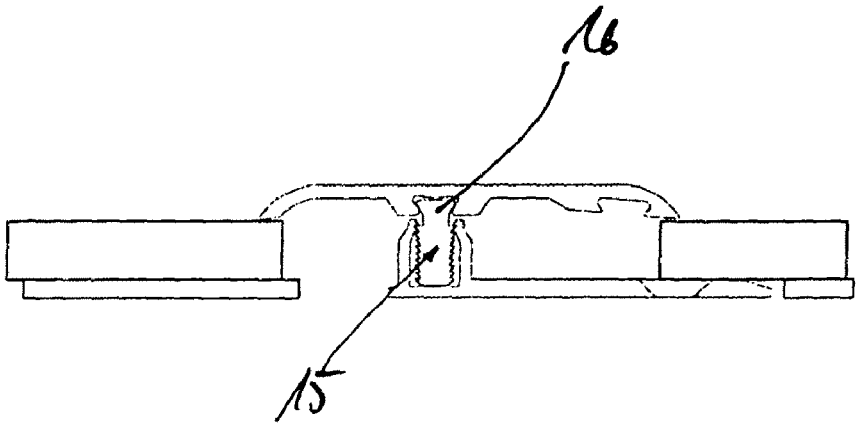
Figure 19:
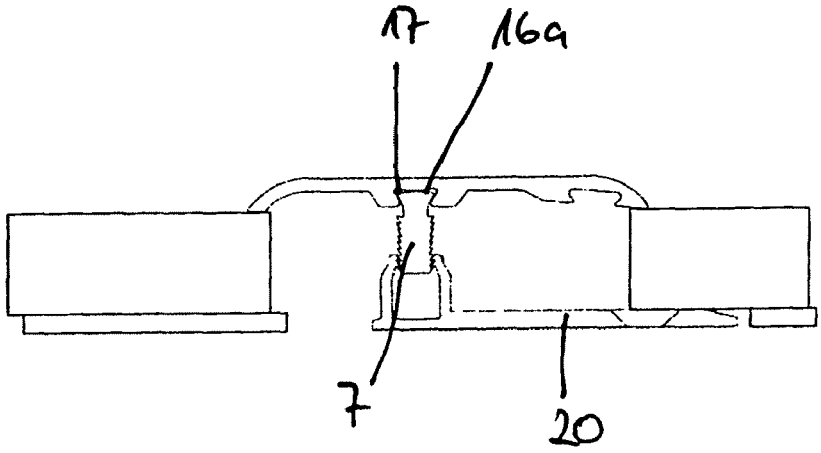
Figure 20:
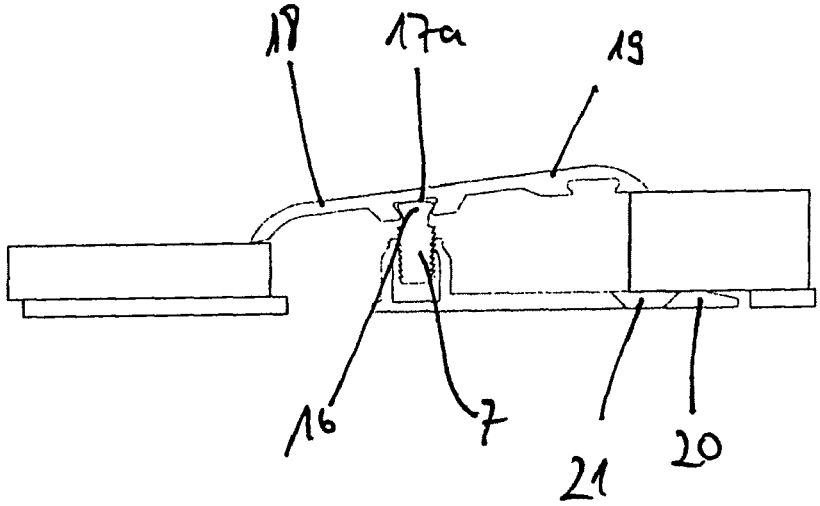

FIGS. 18 to 20 show a different version of the articulated head 16 and the groove 17. The groove 17 is made in the shape of a dovetail, the lower groove surface 17*a* being arched to the outside. The articulated head 16 is accordingly dovetail-shaped, the outer head surface 16*a* likewise being arched to the outside. As a result of the execution of the articulated head 16 and groove 17 arched to the outside and based on the play between the articulated head 16 and the groove 17, in contrast to the embodiments as show in FIGS. 1 to 10, there is only spot or partial surface contact of the head surface 16*a* with the groove surface 17*a*. The head surface 16*a* does not adjoin the groove surface 17*a* over the entire surface in any state. This embodiment has the advantage that it is relatively flat so that correspondingly little space is required for this version. Another difference from the embodiment as shown in FIGS. 1 to 10 consists in that the latching profile 7 for the intermediate piece as shown in FIGS. 18 to 20 is thicker, here roughly twice as thick as in the initially described embodiment.

Otherwise, the individual figures show that the latching profile 7 which projects down is located off-center on the cover profile 4. The off-center arrangement results in a shorter cover leg 18 and a longer cover leg 19. The length ratio between the two cover legs 18, 19 is between 1.2 and 2.0. In the illustrated embodiment, the length ratio is roughly 1.4. The cover legs 18, 19 of different length enable better equalization of heights.

Otherwise, in all the illustrated embodiments, it is such that the base profile 3, the cover profile 4 and the intermediate profile 15 are made of extruded aluminum strips of given length, the base profile 3, the cover profile 4 and the intermediate profile 15 preferably each having the same length.

For joining to the subfloor, the base profile 3 has a bottom leg profile 20 in which there are a plurality of screw openings 21. In the illustrated embodiments, one element of the surface covering 2 rests on the free end of the bottom leg profile 20; however, it need not necessarily be so.

Otherwise, in the embodiments shown in FIGS. 5 to 8 and 14 to 17, it is such that there is a side terminating profile 22 which can be connected to the cover profile 4. This terminating profile 22 is used here for closing off the edge when using the profile strip system 1. Even if it is fundamentally possible to forego the side terminating profile 22 by a corresponding shape and execution of the cover profile 4 with a lengthened and downwardly pointed leg, this profile has the advantage that only one type of cover profile is required, and if necessary, the side terminating profile 22 can be used. To join the terminating profile 22 to the cover profile 4, on the cover profile 4, there is a dovetail-shaped groove 23 for inserting a correspondingly matched projection 24 provided on the top side on the terminating profile 22. The insertion of the projection 24 of the terminating profile 22 into the groove 23 on the cover profile 4 takes place conventionally by sliding it in.

In this connection, it is pointed out that the terminating profile 22, in terms of its length, is matched to the length of the cover profile 4, and otherwise, also preferably, is made of aluminum. Otherwise, the individual figures show that the groove 23 is located at an acute angle diagonally relative to the top 25 or the horizontal. As follows, for example, from FIGS. 7 & 8 and 16 & 17, the diagonal arrangement can prevent the terminating profile 22 from striking the latching receptacle 6 when pivoting.

As otherwise follows from the drawings, the terminating profile 22 has an inverted U-shape. However, fundamentally, a hollow body version is also possible. The two outer legs 26, 27 have a different slope. This makes it possible to achieve different installation situations depending on the arrangement of the terminating profile 22. The shape of the legs 26, 27 in the region of the transition to the cover profile 4 is chosen such that the transition is essentially stepless.

It is not shown that the profile strip system 1 can be offered as a kit, specifically with at least one base profile 3, at least one cover profile 4 and at least two different intermediate profiles 15, the length of the latching profiles 7 of the intermediate profiles 15 being different. It goes without saying here that, fundamentally, there can also be a plurality of bottom profiles and cover profiles, then the number of intermediate profiles can be matched accordingly. Moreover, the kit can also have at least one terminating profile 22.

Figure 1:
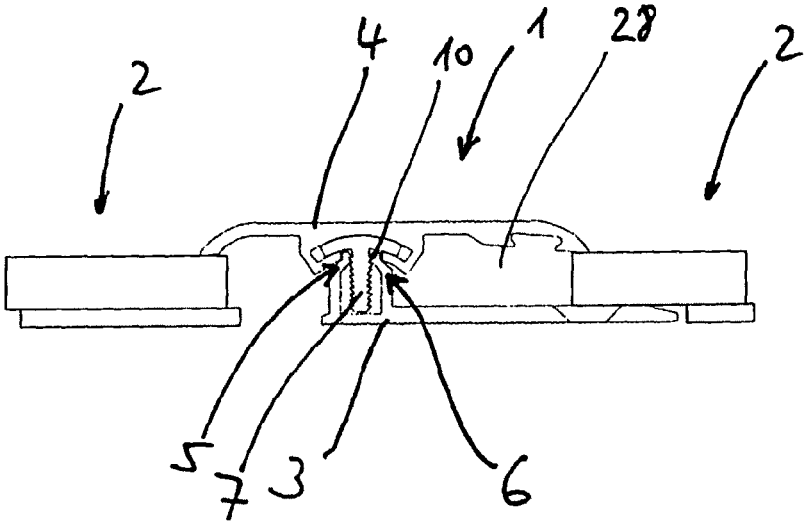
FIGS. 1-4 show views of the profile strip system in accordance with the invention between two surface covering elements of varying sizes.
Figure 2:
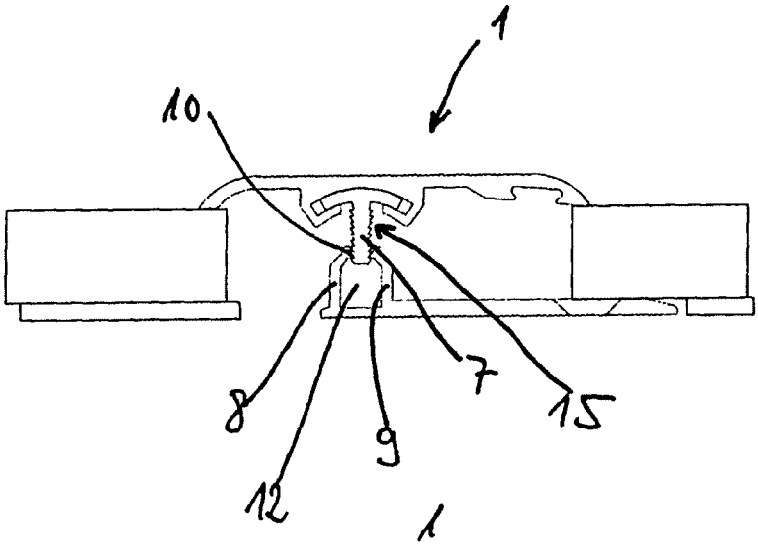

The differences between the individual figures are indicated below. In FIGS. 1 to 8, there is a profile strip system 1 with a shorter latching receptacle 6 and a shorter intermediate piece 15. FIGS. 1 to 4 show the use of the profile strip system 1 for concealing a joint 28. In FIGS. 1 & 2, the cover profile 4 conceals a joint 28 which, in FIG. 1, is formed between two relatively flat elements of the covering 2, and in FIG. 2, between two conversely thicker elements of the covering 2. FIG. 3 shows the state in which the covering elements which form the joint 28 are made with different heights. In FIG. 4, the height difference between the bottom covering elements on the joint 28 is still larger. In this connection, there is not only pivoting of the cover profile 4 relative to the intermediate piece 5, but also pivoting of the intermediate piece 15 relative to the latching receptacle.

In FIGS. 5 to 8, the above described profile strip system 1 is used to close off the edge; in this case, there being a terminating profile 22. The latter is inserted into the cover profile 4 in two different installation situations.

FIGS. 9 & 10 correspond fundamentally to FIGS. 1 & 2, and in this connection, the profile strip system 1 has a taller latching receptacle 6 and a longer intermediate piece 15.

Figure 11:
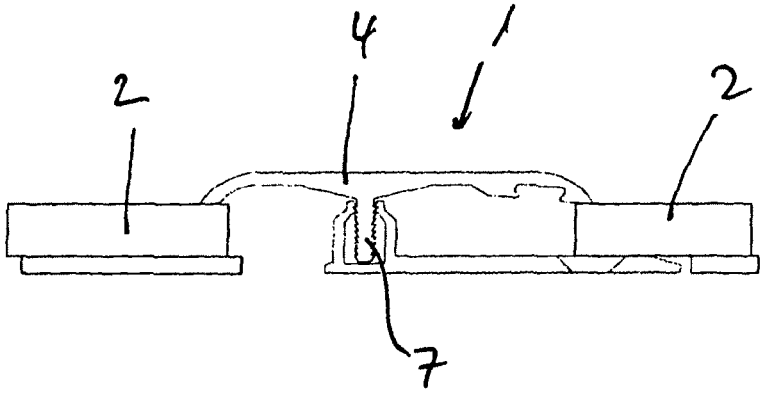
FIGS. 11-13 show views of another embodiment of the profile strip system in accordance with the invention as used for joint concealment.
Figure 12:
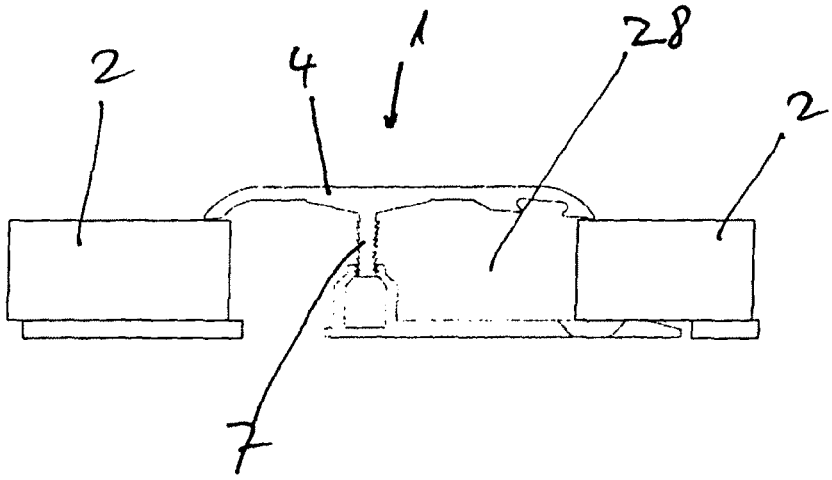

In FIGS. 11 to 13, a two-part profile strip system 1 for covering a joint 28 is shown, in which the latching profile 7 is made in one piece with the cover profile 4. Here, FIGS. 11 & 12 show the maximum possible height adjustments. FIG. 13 shows the profile strip system 1 from FIGS. 11 & 12 in the pivoted state with covering elements of different heights.

FIGS. 14 to 17 show the profile strip system from FIGS. 11 to 13 for closing off the edge, and in this case, there is a terminating profile 22 which is inserted into the groove 23 of the cover profile 4 in different installation situations.

Figure 3:
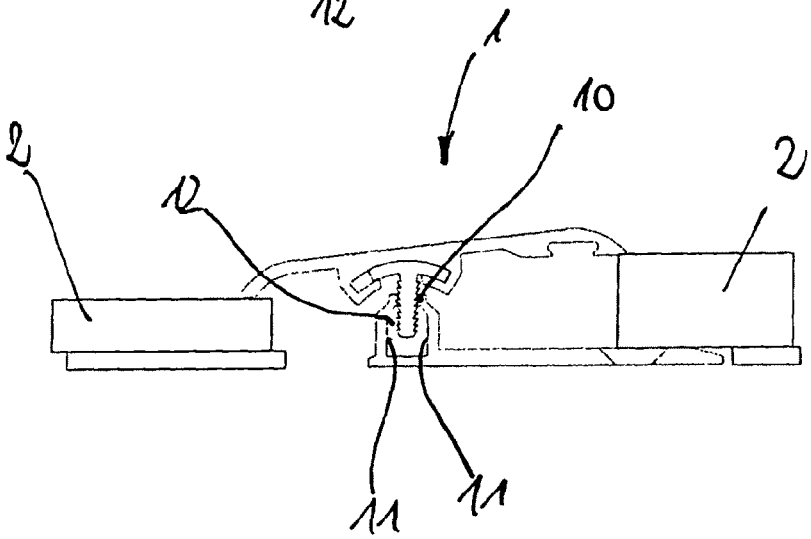
Figure 4:
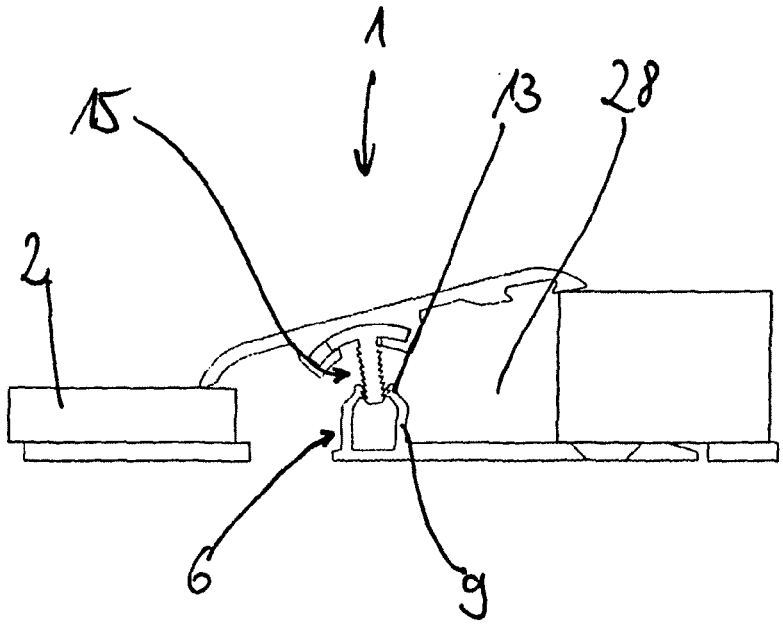
Figure 5:
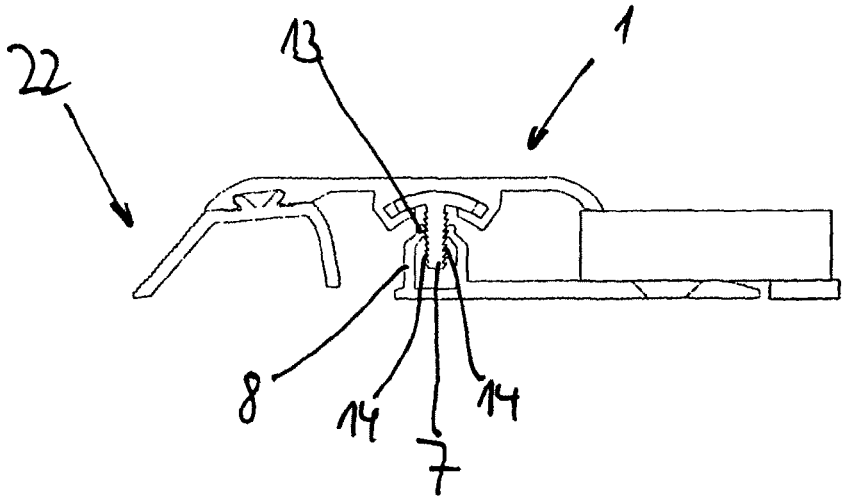
FIGS. 5-8 show varying configurations of the profile strip system where one edge is closed off with a terminating profile.

Finally, FIGS. 18 to 20 show another embodiment of a profile strip system 1 with states according to FIGS. 1 to 3 being shown, to which reference should be made. The difference being in the execution of the intermediate piece and the implementation of the pivoting capacity of the intermediate piece 15 relative to the cover profile 4.

What is claimed is:

1. Profile strip system for closing off an edge and for concealing a joint, comprising:

a lower base profile, an upper cover profile, and a latching connection between the base profile and the cover profile for connecting the lower base profile to the upper cover profile, the latching connection having a latching receptacle, on the base profile, with two leg profiles with opposite latching regions and latching region-free sections, and a latching profile which is latchable into the latching receptacle and which has a plurality of latching sites, each latching region having at least two latching sites, the latching regions being located on only a portion of the leg profiles and the latching region-free sections being spaced apart by a greater distance than the latching regions, wherein the latching profile is located on an intermediate profile which is connectable to the cover profile, the intermediate profile having an articulated head and the cover profile having a groove on a bottom side thereof into which the articulated head is insertable, the groove and head being configured relative to each other in a manner enabling the articulated head to swing within the groove; and wherein the groove is in the shape of a dovetail and has an arched groove surface and wherein the articulated head is in the shape of a dovetail and has an outwardly arched head surface opposite the groove surface so that there is only spot or partial surface contact between the groove surface and the head surface.

2. Profile strip system as claimed in claim 1, wherein the latching regions are only on outer free ends of the leg profiles.

3. Profile strip system as claimed in claim 1, wherein the leg profiles are spring legs.

4. Profile strip system as claimed in claim 1, wherein a maximum distance between the latching region-free sections of opposite leg profiles which are usable for swinging of the latching profile is at least 1.2 times greater than an inside width between the latching regions.

5. Profile strip system as claimed in claim 1, wherein a maximum distance between the latching region-free sections of opposite leg profiles which are usable for swinging of the latching profile is at least 2 times greater than an inside width between the latching regions.

6. Profile strip system as claimed in claim 1, wherein the latching profile inserted into the latching receptacle swingable relative to the vertical in a region in an angular range of between 1° and 10°.

7. Profile strip system as claimed in claim 1, wherein an upper region of each of the leg profiles is bent.

8. Profile strip system as claimed in claim 1, wherein the length of the leg profiles is more than twice the length of the latching region.

9. Profile strip system as claimed in claim 1, wherein the latching region has from 2-6 latching sites.

10. Profile strip system as claimed in claim 1, wherein the latching regions of the leg profiles are vertically aligned.

11. Profile strip system as claimed in claim 1, wherein the latching profile has latching regions with a plurality of latching sites on opposite sides thereof, the latching regions running parallel to one another.

12. Profile strip system as claimed in claim 1, wherein the leg profiles are located on top on the lower base profile.

13. Profile strip system as claimed in claim 1, wherein the cover profile is swingable relative to the intermediate profile in an angular region relative to the vertical of up to 20°.

14. Profile strip system as claimed in claim 1, wherein the latching profile is arranged off-center relative to the cover profile so that cover legs of different lengths are formed.

15. Profile strip system as claimed in claim 1, wherein the base profile and the cover profile are made of aluminum.

16. Profile strip system as claimed in claim 1, wherein the base profile has a bottom leg profile for connection to the subfloor.

17. Profile strip system as claimed in claim 1, further comprising a side terminating profile which is connectable to the cover profile.

18. Profile strip system as claimed in claim 17, wherein a groove is provided on the bottom on the cover profile for receiving a projection provided on the top on the terminating profile.

19. Profile strip system as claimed in claim 1, wherein the groove is located diagonally relative to the top of the cover profile.

20. Profile strip system as claimed in claim 17, wherein the terminating profile has a body that is one of U-shaped and hollow with two outer legs having a different slope from each other.

21. Profile strip system as claimed in claim 1, wherein the system is in the form of an unassembled kit that is provided with at least one base profile, at least one cover profile and at least two intermediate profiles with latching profiles of different length.

22. Profile strip system as claimed in claim 21, wherein the kit also has at least one side terminating profile which is connectable to the cover profile.

23. Profile strip system for closing off an edge and for concealing a joint, comprising:

a lower base profile having a latching receptacle, an upper cover profile having an arcuate groove on a bottom side, and an intermediate profile with an articulated head which is insertable into the arcuate groove of the cover profile and with a latching profile which is latchable within the latching receptacle;

wherein the latching receptacle has two leg profiles with opposed latching regions, each of the two leg profiles having a latching region and a latching region-free section, the latching region-free sections of the leg profiles being spaced apart from each other by a greater distance than the latching regions of the leg profiles, wherein the latching profile has a plurality of latching sites which are engageable with the opposed latching regions of the latching receptacle and a free end of the latching profile being variably extendable into a free space formed between the latching region-free sections, and wherein the arcuate groove of the cover profile is configured relative to the articulated head so as to enable the articulated head to swing within the arcuate groove, and the latching profile can be inserted into the latching receptacle such that the latching profile can be pivoted relative to the latching receptacle and the base profile.

24. Profile strip system as claimed in claim 23, wherein the groove is in the shape of a dovetail and has an arched groove surface and wherein the articulated head is in the shape of a dovetail and has an outwardly arched head surface opposite the groove surface so that there is only spot or partial surface contact between the groove surface and the head surface.

* * * * *